US006253440B1

(12) United States Patent
Chen

(10) Patent No.: US 6,253,440 B1
(45) **Date of Patent: *Jul. 3, 2001**

(54) METHOD OF MANUFACTURING SELF COOLING BEVERAGE CONTAINER

(75) Inventor: Jeffrey W. Chen, Irvine, CA (US)

(73) Assignee: Chill-Can International, Inc., Laguna-Niguel, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/229,294

(22) Filed: Jan. 13, 1999

(51) Int. Cl.[7] ..... B21D 39/00; B21D 39/03
(52) U.S. Cl. ..... 29/509; 29/505; 29/428
(58) Field of Search ..... 29/34 R, 505, 29/428, 509; 72/324; 62/293, 294, 457.9; 220/601, 23.87, 23.9, 625

(56) References Cited

U.S. PATENT DOCUMENTS 1,040,160 * 10/1912 Davis ..... 29/34 R
2,422,952 * 6/1947 Dakin ..... 29/34 R
2,460,765 * 2/1949 Palaith ..... 62/293
3,269,141 * 8/1966 Weiss ..... 62/294
3,373,581 * 3/1968 Strader ..... 62/293
3,457,761 * 7/1969 Brosseit ..... 72/324
3,494,142 * 2/1970 Beck ..... 62/294
4,584,848 * 4/1986 Barnett ..... 62/294
4,656,838 * 4/1987 Shen ..... 62/293
4,925,470 * 5/1990 Chou ..... 62/294
5,214,933 * 6/1993 Aitchison et al. ..... 62/294
5,331,817 * 7/1994 Anthony ..... 62/293
5,606,866 * 3/1997 Anthony et al. ..... 62/294
5,655,384 * 8/1997 Joslin, Jr. ..... 62/294
5,921,439 * 7/1999 Losenno et al. ..... 222/95
6,102,108 * 8/2000 Sillince ..... 62/294
6,105,384 * 8/2000 Joseph ..... 62/293
6,125,649 * 10/2000 Sillince ..... 62/294

* cited by examiner

*Primary Examiner*—S. Thomas Hughes
*Assistant Examiner*—Marc Jimenez
(74) *Attorney, Agent, or Firm*—Fulbright & Jaworski L.L.P.

(57) ABSTRACT

A method of forming a flange in the bottom of a container by first removing a portion of the container bottom and then forming or swaying the material around the opening to form a flange extending away from the container bottom. A valve and valve cup assembly along with a heat exchange unit are positioned adjacent the flange and the combination is crimped to permanently affix the heat exchange unit to the bottom of the container.

7 Claims, 4 Drawing Sheets

METHOD OF MANUFACTURING SELF COOLING BEVERAGE CONTAINER

BACKGROUND OF THE INVENTION

This invention relates generally to self-cooling and self-heating fluid containers and more specifically to such a container which includes a heat exchange unit affixed internally thereof and which is portable and disposable.

DESCRIPTION OF THE PRIOR ART

Many foods and beverages available in portable containers are preferably consumed when they are chilled, for example, carbonated soft drinks, fruit drinks, beer, water, puddings and gelatins and the like are preferably consumed with temperature varying between 35° Fahrenheit and 50° Fahrenheit. When the convenience of refrigerators or ice is not available, such as when fishing, camping, on the beach or the like, the task of cooling these foods or beverages prior to consumption is made more difficult. In such circumstances one normally is required to utilize an ice chest and to provide ice which will last only a limited period of time and is bulky, difficult to handle and requires draining of the melted ice from time to time. In such circumstances it is highly desirable to have a method for rapidly cooling the contents of the containers prior to consumption without the necessity of these prior art inconveniences.

The prior art is replete such self-cooling beverage containers. Generally, such containers utilize a refrigerant, gas of some type, or an endothermic reaction to provide the cooling means. Typical of such self-cooling devices known to applicant for chilling beverages and the like are exemplified by the structures disclosed in the U.S. Pat. Nos. 2,746,265; 1,897,723; 2,882,691; 2,460,765; 3,373,581; 3,636,726; 3,726,106; 4,584,848; 4,656,838; 4,784,678; 5,214,933; 5,285,812; 5,325,680 and 5,331,817.

Many of these prior art structures utilize an activation process wherein the pulltab which is utilized for removing the cooled contents of the beverage can is also utilized as the activating device to release the refrigerant from a heat exchange unit which is contained internally within the beverage can. In some instances, a differential pressure generated within the beverage can is utilized to effect activation of the heat exchange unit to release the refrigerant contained therein to cool the beverage. Although these structures function quite adequately to release the refrigerant to conduct the heat contained within the food or beverage away from the food or beverage and thereby to cool it, it has been found that such structures are complicated, expensive to produce and sometimes interfere with the consumption of the beverage from the can.

As a result, it has been recognized in the art that it is more effective and efficient to separate the activation of the heat exchange unit from the removal of the food or beverage contents subsequent to the cooling step. This has been accomplished by placing the heat exchange unit in the bottom of the can and the pull-tab at the top of the can as it is traditionally located. Examples of the such prior art apparatus are shown in U.S. Pat. Nos. 4,656,838 and 4,555,741. In each of these prior art applications the heat exchange unit is affixed to the bottom of the beverage can and is also actuated from the bottom of the beverage can. The actuation in each instance includes a mechanism for puncturing a wall or diaphragm located in the bottom of the can which closes and seals the heat exchange unit. Although these structures solve some of the problems of the prior art, the mechanisms utilized are difficult to construct and do not provide adequate protection against inadvertent activation of the HEU.

Prior art devices also exist which provide an exothermic reaction to in situ heat food or beverages. Such devices are convenient and useful in the same manner and for the same reasons as above set forth with respect to self-cooling containers. One example of such a prior art device is disclosed in prior art U.S. Pat. No. 5,620,022. Although the heat exchange unit for that structure is affixed in the can bottom and is separately activated, the structure is complex and expensive to manufacture.

SUMMARY OF THE INVENTION

A method of manufacturing a container having a heat exchange unit therein which includes removing a predetermined amount of material from the central part of the bottom of the container, forming a flange extending substantially perpendicular with respect to the bottom and surrounding the opening, and affixing a heat exchange unit to the flange.

A can which includes a top and bottom and having a heat exchange unit affixed to the bottom of the can by a flange formed integrally with the bottom of the can. The heat exchange unit and a valve cup disposed on each side of the flange and permanently affixed to the flange by forming.

DETAILED DESCRIPTION OF THE INVENTION

Figure 1:
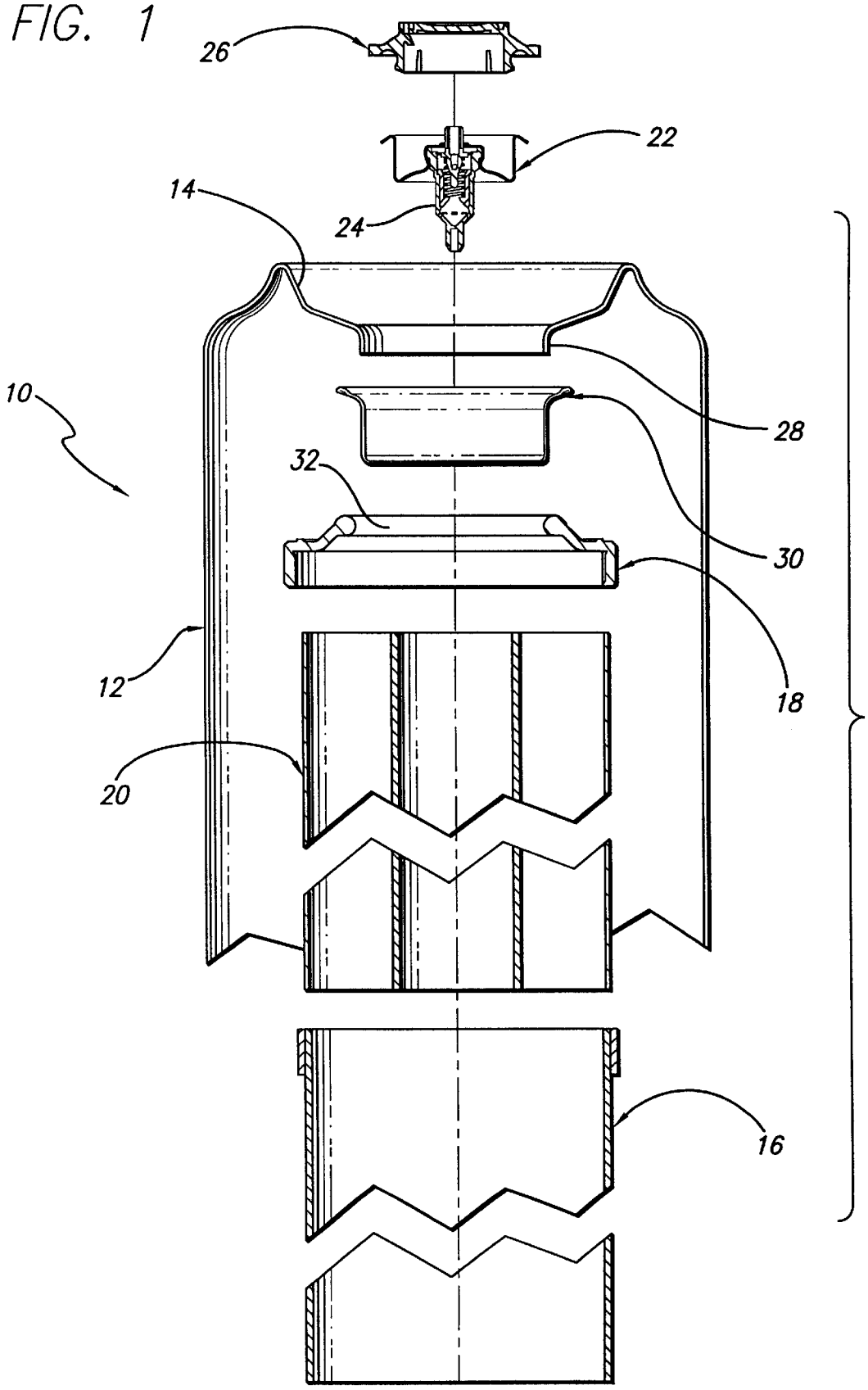
FIG. 1 is an exploded view of a self-chilling or self-heating beverage container constructed in accordance with the principles of the present invention.

Referring now more particularly to FIG. 1 there is illustrated in exploded view the components of a self chilling beverage container constructed in accordance with the principles of the present invention. Although the present invention is equally applicable to self-chilling or self-heating food or beverage containers, the following description is given with respect to a self-chilling beverage container for purposes of use of illustration and description but without limitation of the invention. As is therein shown, the overall self-chilling beverage assembly 10 includes a beverage can 12 having a bottom 14 and a top (not shown). A heat exchange unit (HEU) comprises a vessel 16 having a lid 18 which will be affixed to the vessel 16 by crimping, welding, adhesives or the like. The HEU may be a single piece structure with the top necked in for attachment. The vessel 16 contains a refrigerant which may be any known to the art type of material such as hydro fluro-carbons, chloror fluro carbons, carbon I dioxide, a mixture of hydro carbons and halogen gases or the like. In the presently preferred embodiment of this invention the refrigerant is a carbon dioxide-carbon adsorbent/desorbent system of the type disclosed in U.S. Pat. No. 5,692,381 to which reference is hereby made and by such reference is incorporated herein. When a device of the type utilizing the carbondioxide system as the refrigerant is used, it becomes desirable to provide a heat sink such as is illustrated at 20 to assist in conducting the heat in the beverage contained within the beverage can 12 from the surface of the heat exchange vessel 16 internally to be exhausted from the system 10 upon activation of the heat exchange unit. Also provided is a valve cup 22 which includes a valve 24 secured thereto. A protective cover or cap 26 fits over the valve 24 to protect it from inadvertent actuation thereby activating the heat exchange unit when such is not desired and to provide an indicator to the consumer that the unit has not been activated. The combination of the valve cup 22 and the heat exchange unit must be affixed to the bottom 14 of the beverage can 12. Such is done by providing a downwardly directed flange 28 in the bottom 14 of the can. That flange is sandwiched between the valve cup 22 and the cap or top 18 of the heat exchange unit and the material, preferably metal, from which these units are formed, is then formed such as by crimping or swaging to secure these elements together and thereby to affix the heat exchange unit permanently to the bottom 14 of the beverage can 12. An elastomeric material such as a washer 30 is positioned between the flange 28 and the inner surface 32 of the cap 18 of the heat exchange unit to provide an effective seal there between. A similar elastomeric material is coated on the exterior surface of the valve cup 22 and thus also provides a seal between the valve cup 22 and the beverage can 14. The critical factor in accordance with the principles of the present invention is to provide a means for sealing and permanently attaching the heat exchange unit to the bottom of the beverage can. In accordance with the principles of the present invention this means is the downwardly directed flange 28 which as will become apparent below is formed as an integral part of the beverage can 12. Although the flange 15 shown directed downwardly in FIG. 1, it should be understood that with certain modifications the flange may be directed upwardly (out of the container).

Figure 2:
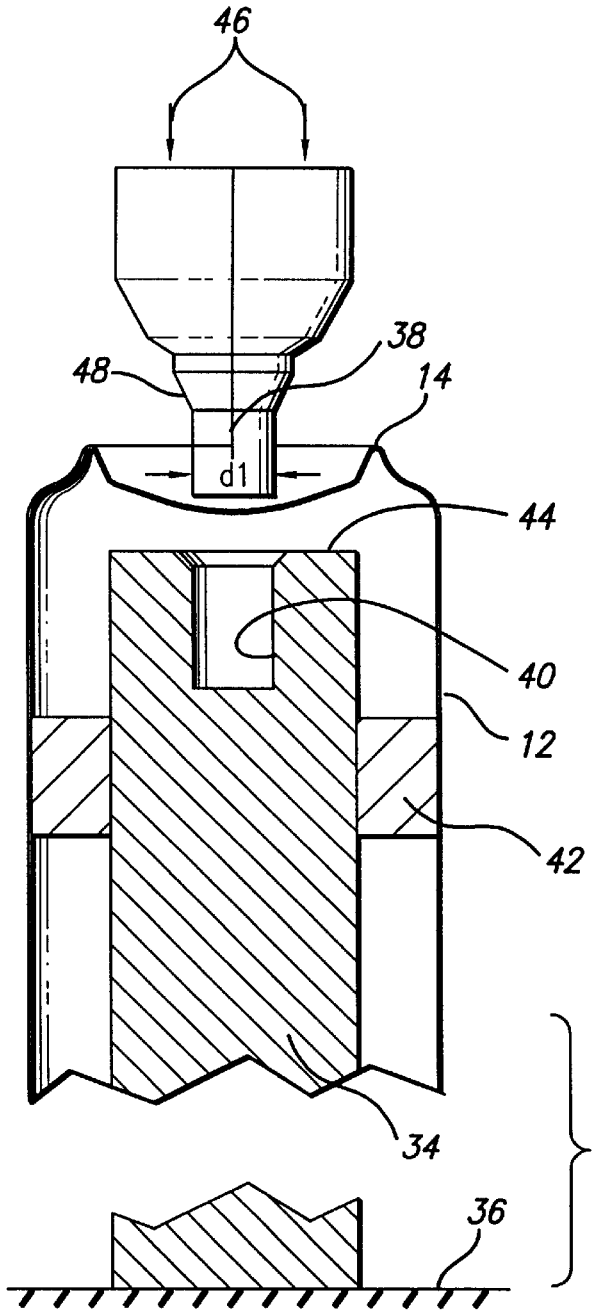
FIG. 2 illustrates one step in the formation of an attaching flange in the bottom of the beverage container.
Figure 4:
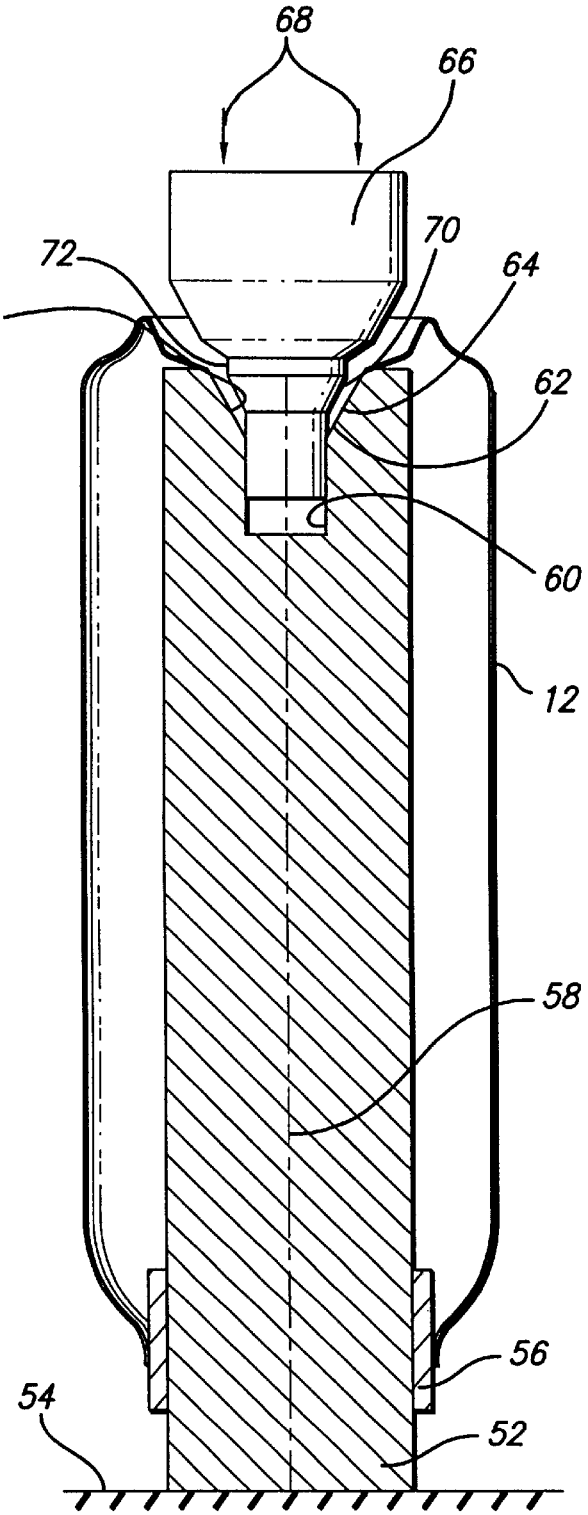
FIG. 4 illustrates the second step in the formation of the flange used in the beverage container of the present invention.

By referring now to FIGS. 2 and 4 there is shown the apparatus for forming the flange 28 in the bottom of the can. It will be appreciated by those skilled in the art that what is illustrated in FIGS. 2 and 4 are schematic sketches of apparatus to carry out the fabrication methods for forming the flange 28. In actual production and particularly in mass production the equipment will be automated and much more sophisticated than that illustrated in FIGS. 2 and 4. Nonetheless, the principle involved will be the same and therefore the invention is not to be limited by the drawings.

Figure 3:
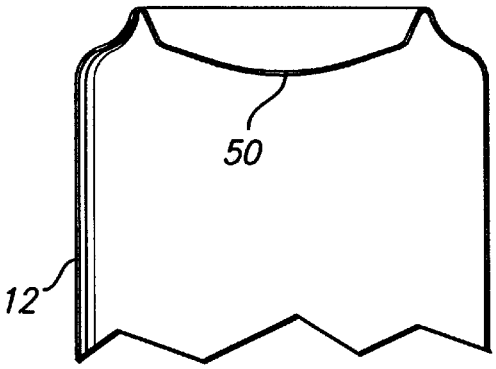
FIG. 3 illustrates the beverage container after the step as illustrated in FIG. 2.

In order to form the flange 28 some material must first be removed from the bottom 14 of the beverage can. As is shown in FIG. 2, there is provided an anvil 34 which rests upon a foundation 36 such that the anvil is well supported and in a position to receive the forces generated by the acceptance of a punch 38. The outer diameter d1 of the punch 38 is substantially the same as the diameter of the bore 40 which is formed in the upper portion of the anvil 34. There will be a sufficient difference between the diameters to permit clearance for the punch 38 to enter the bore 40 without binding. The material removal is accomplished by positioning the beverage can 12 over the anvil 34 with the bottom 14 of the can positioned over the bore 40. The can 12 should be centrally positioned upon the anvil 34 and an appropriate jig such as a spacer 42 may be positioned around the anvil 34. Obviously other devices may be utilized for properly positioning the can 12 centrally with respect to the anvil 34. Once the can has been thusly positioned it is moved downwardly as viewed in FIG. 2 so that the bottom 14 of the can rests securely upon the top surface 44 of the anvil with the center of the bottom 14 positioned directly over the center of the bore 40. Appropriate force is then applied to the punch 38 as illustrated by the arrows 46 to move the punch downwardly and to permit the lower portion thereof to enter the bore 40. It should be noted particularly with respect to FIG. 2 that only the lower portion of the punch 38 which has the diameter d1 which is substantially the same as the inner diameter of the bore 40 can enter the bore 40. Once the outwardly flared portion 48 of the punch 38 reaches the bore 40, further downward movement of the punch 38 is restricted. It will be understood however that the central portion of the bottom 14 of the beverage can 12 is severed from the beverage can by the downward movement of the punch 38. Once this occurs the structure is as illustrated in FIG. 3 wherein the beverage can 12 is illustrated as having an opening or aperture 50 there through. The aperture 50 is formed by having removed the material by moving the punch 30 from the position shown in FIG. 2 downwardly into the aperture 40.

Obviously, other devices may be used for removing the material from the bottom of the can. For example, a cutting knife edge may be formed on the anvil or the end of the punch with the other surface being flat or defining a slight groove. When the surfaces meet with the can material there between, a predetermined amount of material is severed and removed. The amount of material to be removed is that which is sufficient to allow formation of the flange as described below without fracturing or otherwise destroying the integrity of the remaining portion of the bottom of the can.

Figure 5:
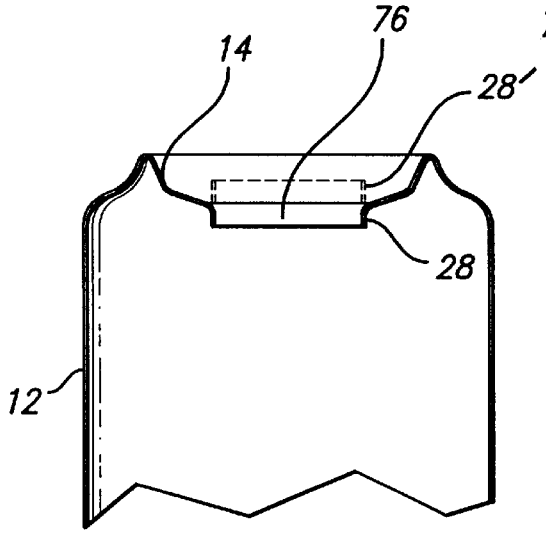
FIG. 5 illustrates the beverage can subsequent to the step illustrated in FIG. 4.

By reference now to FIGS. 4 and 5 the second step in forming the flange 28 is illustrated. As is shown in FIG. 4 the beverage can 12 is positioned over an anvil 52 which is formed similarly to that illustrated in FIG. 2 and which also rests upon a foundation 54 for the purposes as above described. The anvil also includes a spacer mechanism 56 to centrally position the can 12 with respect to the center line 58 of the anvil 52. Although the anvil 52 is similar in structure to the anvil 34 and includes a bore 60 therein, it should be noted that the bore tapers outwardly as illustrated at 62 and terminates in a re-entrant bore 64 which has a diameter greater than the bore 60. Likewise, the punch 66, which is propelled downwardly as illustrated by the arrows at 68 also tapers outwardly as illustrated at 70 and terminates adjacent the upper portion of the punch 66 in a vertically disposed region 72. It will be noted by examination, that the punches 38 and 66 are constructed substantially the same, however, the anvils 52 and 34 have a differently shaped bore as above-described. Through utilization of the anvil having the bore with the flare 62 and the straight diameter 64, when the punch 66 is permitted to totally enter the bore 60 to its full limit, the inner edge 74 surrounding the opening 50 in the can 12 is moved downwardly first by the tapered surface 70 and then finally formed by being positioned between the vertical opposed surfaces 72 and 64 on the punch 66 and the anvil 52 respectively. Obviously the outer diameter of the surface 72 of the punch 66 is slightly less then the inner diameter of the vertical surface 64 of the bore 60 by an amount substantially equal to the thickness of the material of the beverage can bottom 14. The end result is as shown in FIG. 5 which clearly illustrates the downwardly directed (into the container) flange 28 surrounding an opening 76 in the bottom 14 of the can 12. As above indicated the flange 28 is of a sufficient size to receive the elastomeric washer 30 and opening 32 in the cap 18 of vessel 16 around its outer diameter and to receive the valve cup 22 at its inner diameter. Through the utilization of appropriate forming tools the flange 28, the cap 18 and the valve cup 22 are formed so as to provide a sealed self-cooling beverage system.

In some applications it is desirable to affix the valve and valve by assembly to the can in such manner that there is no possibility of an internal leakage path for the refrigerant (or exothermic materials) to enter the food or beverage in the container. Such may be done by reversing the flange forming procedure as above described. The can 12 is positioned with the opening 50 centered over the bore 64 in the anvil but with the side or body of the can extending upwardly as viewed in FIG. 4. The punch 66 is directed downwardly as above described with the result that the direction of the flange is upwardly (out of the container) as viewed in FIG. 5, and as shown by the dashed line 28. The flange 28 may then be curled over with an extension of the HEU and the valve cup received and formed as above described to provide an effective sealed permanently affixed HEU.

In some instances where the container is made of aluminum material the flange may be annealed to prevent further cracking when the crimping occurs. Such annealing may be accomplished by use of a polishing buff which rotates a high speed in contact with the flange. Such raises the temperature of the flange sufficiently to anneal it.

Figure 6:
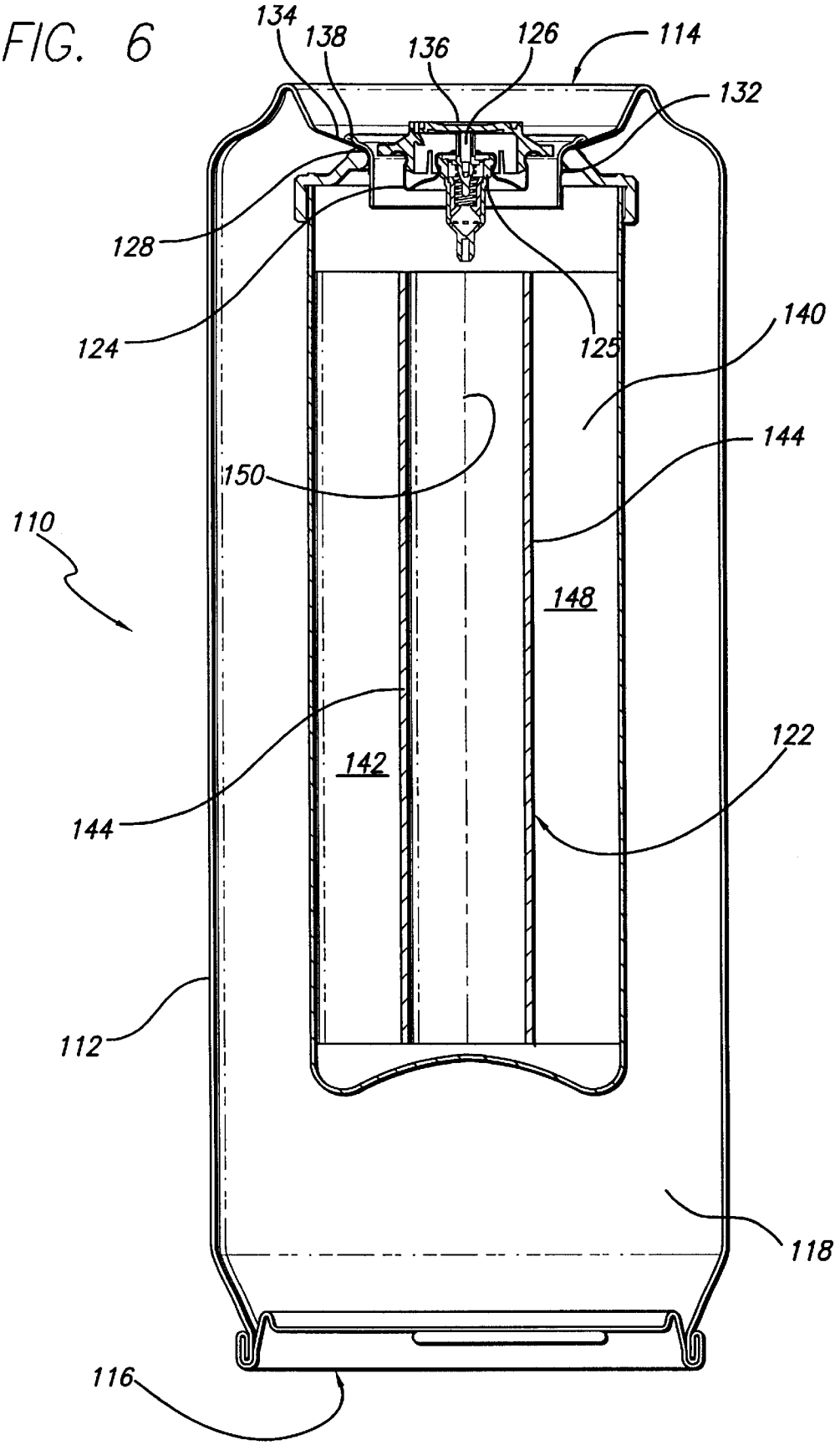
FIG. 6 illustrates a completed self-chilling beverage container constructed in accordance with the present invention.

Referring now more particularly to FIG. 6, there is illustrated in schematic form and in partial cross-section a completed self-cooling beverage system constructed in accordance with the principles of the present invention. As is therein shown the system 110 includes the beverage can 112 having a bottom 114 and a top 116. The beverage can 112 contains a beverage 118. A heat exchange unit 122 having a valve cup 124 including a valve 125 disposed therein and having a button 126 which may be depressed to activate the valve is provided. The bottom 114 of the can 112 has an opening and a downwardly depending flange 128 which is sandwiched between the upper end 132 of the heat exchange unit 122 and the valve cup 134. As above-described an appropriate elastomeric washer is disposed between the surfaces of the flange 128 and the valve cup and heat exchange unit to effect the desired seals. A protective cap 136 is disposed over the valve 125 and is held in place by snapping the same downwardly through the utilization of an appropriate retaining clip 138. When the upper surface of the protective cover 136 is depressed downwardly it will contact the button or plunger 126 activating the valve 125 to release the refrigerant contained within the heat exchange unit 122. If the heat exchange unit utilizes a carbon carbon-dioxide system as above described then the appropriate heat sink 140 is disposed internally of the heat exchange unit 122 and is in the form of a plurality of ribs 142 through 148 which converge at a central point 150. Each of the ribs is in contact with the inner wall of the HEU 122 and conducts the heat contained within the beverage 118 internally through the carbon so that it may be exhausted upwardly through the valve 125 with the escaping carbon-dioxide gas. Obviously, the heat exchange unit and the refrigerant may take many other forms and may also be replaced by an exothemic reaction system without departing from the spirit or scope of the present invention which is directed to the manner of attaching the heat exchange unit to the bottom of the food or beverage container.

What is claimed is:

1. A method of manufacturing a self cooling beverage container comprising the steps of:

a. providing a beverage can having an open top and a closed bottom;

b. removing a predetermined amount of material centrally from said bottom of said can to provide an opening therethrough;

c. forming a flange having an inner and outer diameter and extending substantially perpendicular with respect to said bottom from material of said can bottom immediately surrounding said opening;

d. providing a separate heat exchange unit;

e. providing a separate valve cup carrying a valve:

f. positioning said heat exchange unit completely within the beverage can and adjacent one of said inner and outer diameters of said flange;

g. positioning said valve cup outside the beverage can and adjacent the other of said inner and outer diameters of said flange; and h. permanently affixing said flange to said heat exchange unit and said valve cup.

2. A method of manufacturing a container as defined in claim 1, wherein said removing step includes providing an anvil and a punch defining cutting edges, positioning said beverage can with said closed bottom centrally disposed on said anvil and bringing said cutting edges into contact with said bottom with sufficient force for removing said material.

3. A method of manufacturing a self-cooling beverage container as defined in claim 1, wherein said removing step includes providing an anvil defining a bore having a first diameter, positioning said beverage can with said bottom centrally disposed over said bore and inserting a punch through said bottom and into said bore thereby removing said material.

4. A method of manufacturing a container as defined in claim 3, wherein said forming step includes providing an anvil defining a bore having a first diameter and a reentrant bore having a second diameter;

said second diameter being greater than said first diameter and a tapered region interconnecting said first and second bores;

providing a punch having first and second diameters separated by a tapered section said second diameter of said punch being greater than said first diameter thereof and said second diameter of said punch being less than the diameter of said reentrant bore of said anvil, positioning said can bottom with said opening therein centrally over said bore in said anvil and inserting said punch into said anvil such that said tapered section of said punch contacts said tapered region of said bore.

5. A method of manufacturing a container as defined in claim 1 wherein said affixing step includes sandwiching said flange between said heat exchange unit and said valve cup.

6. A method of manufacturing a container as defined in claim 5 wherein said affixing step further includes crimping said flange, said heat exchange unit and said valve cup.

7. A method of manufacturing a container as defined in claim 5 which includes the further step of placing an elastomeric sealing material between said flange and said valve cup and between said flange and said heat exchange unit.

* * * * *